US006755232B1

(12) United States Patent
Holland et al.

(10) Patent No.: US 6,755,232 B1
(45) Date of Patent: Jun. 29, 2004

(54) FABRIC CLOSURE FOR OPEN-END CARGO CONTAINERS

(75) Inventors: John E. Holland, Bailey, NC (US); Daniel Nathan, Nashville, NC (US)

(73) Assignee: JHRG, LLC, Spring Hope, NC (US)

( * ) Notice: Subject to any disclaimer, the term of this patent is extended or adjusted under 35 U.S.C. 154(b) by 0 days.

(21) Appl. No.: 09/603,061

(22) Filed: Jun. 26, 2000

(51) Int. Cl.[7] ..... E06B 9/30

(52) U.S. Cl. ..... 160/368.1; 244/118.1; 220/1.5

(58) Field of Search ..... 160/368.1, 327, 160/354; 220/1.5; 244/118.1; 410/97, 108, 116; 150/154; 52/3; 296/100.15, 100.16

(56) References Cited

U.S. PATENT DOCUMENTS

| | | | | | |
|---|---|---|---|---|---|
| 1,871,101 | A | * | 8/1932 | Waltz | 135/119 |
| 2,455,237 | A | * | 11/1948 | Davis | |
| 3,173,539 | A | * | 3/1965 | Looker | |
| 4,413,110 | A | | 11/1983 | Kavesh et al. | 526/348.1 |
| 4,429,730 | A | * | 2/1984 | Elston | |
| 4,538,663 | A | | 9/1985 | Looker | 160/368 R |
| 4,601,405 | A | * | 7/1986 | Riemer | |
| 4,741,442 | A | | 5/1988 | Slocumb | 206/597 |
| 4,909,156 | A | | 3/1990 | Erickson | 105/359 |
| 4,944,974 | A | | 7/1990 | Zachariades | 428/36.1 |
| 4,980,227 | A | | 12/1990 | Sekiguchi et al. | 428/241 |
| 5,040,693 | A | | 8/1991 | Podd, Sr. et al. | 220/1.5 |
| 5,092,468 | A | | 3/1992 | Slocumb | 206/597 |
| 5,104,714 | A | | 4/1992 | Leiber et al. | 428/131 |
| 5,110,000 | A | | 5/1992 | Nichols | 220/4.16 |
| 5,377,856 | A | * | 1/1995 | Brierton | |
| 5,395,682 | A | * | 3/1995 | Holland et al. | |
| 6,113,031 | A | * | 9/2000 | Williams et al. | |
| 6,123,294 | A | * | 9/2000 | Genovese | |
| 6,398,287 | B1 | * | 6/2002 | Smith et al. | 296/100.01 |

* cited by examiner

*Primary Examiner*—Blair M. Johnson
(74) *Attorney, Agent, or Firm*—Womble Carlyle Sandridge & Rice, PLLC

(57) ABSTRACT

A fabric closure for open end cargo containers of the type having a plurality of walls, a top wall, a bottom wall, and at least one open end, including a fabric panel formed of high-strength yams, multiple web strap pairs attached to the panel, and adjustable fasteners attached to the web strap pairs to prevent items of cargo stowed in the container from passing around or through the fabric closure.

11 Claims, 6 Drawing Sheets

FABRIC CLOSURE FOR OPEN-END CARGO CONTAINERS

BACKGROUND OF THE INVENTION

The present invention relates generally to curtains or closures for covering the open ends of cargo containers, luggage trailers, and trucks, and, more particularly, to a unitary fabric and webbing closure that functions both as a cut-resistant cargo curtain and a load retainer.

Cargo containers of many forms have been used for transporting land, sea, and air cargo for many years. One type of cargo container is box-like, with at least two side walls, a top, and a flat bottom. Typically, one end of the cargo container is open for loading and unloading cargo. Various door closures can be used for opening and closing the open ends of such containers. One type of closure has been a rigid door closure which covers the opening to reduce tampering, to prevent the loss of small items, and to prevent the cargo from being exposed to dirt, moisture, and ultraviolet light.

Another type of closures include the combination of a webbing and a fabric closure. This type of closure is generally preferred over rigid door closures because it tends to be much lighter and less expensive. The fabric covers have typically been formed from canvas, or vinyl coated nylon or polyester. However, each of these fabrics lacks the durability to withstand physical stresses or lacks resistance to environmental conditions or harsh chemicals common to the transportation industry. For example, exposure to ultraviolet light, diesel and jet fuels, and oils, tends to rapidly degrade such fabric covers. Accordingly, the durability of a cargo cover is ultimately determined by its tear-strength, abrasion resistance, cut-and-stab resistance and ability to withstand environmental and chemical exposure. Otherwise, the product life is very limited and replacement costs are high. Because fabric covers lack the durability to also serve as load retainers, a separate webbing or netting is required to keep the cargo restrained so that it cannot pass through the covered end or fall out.

There is known in the art a cargo curtain in the form of a woven fabric wherein the yarns of the fabric are constructed of long-chain extended (ultra-high molecular weight) polyethylene fibers. Curtains formed from this woven fabric have exhibited increased strength and durability, and are considerably lighter than fabrics previously available. As a result, transportation expenses and replacement costs have been reduced. However, the sheer mass and bulk of cargo stowed in cargo containers still often require that additional measures be taken to secure cargo within the containers so that small articles are not lost and so that large and small articles do not penetrate the cargo curtains. Again, restraining such loads has heretofore been achieved by applying a combination of covers and webbing or nets, thereby increasing the weight, labor requirements, and required parts inventory, while also increasing total transportation costs. Further, by their very design, webbing and nets are subject to entanglement and must be either tediously untangled, or frequently must be cut away, rendering them subsequently unserviceable.

SUMMARY OF THE INVENTION

The present invention is directed to a unitary closure for covering the openings of cargo containers, baggage trailers, or trucks that accomplishes both of the above-described functions. Thus, the closure described hereinafter functions as both a cut-resistant cargo curtain and a load retainer for preventing cargo from falling out of the cargo container or otherwise penetrating the closure. Further, the closure described herein may be installed or removed in a fraction of the time required to install separate covers and nets or webbing and is not subject to the entanglement problems inherent in the prior art.

Accordingly, one aspect of the present invention is to provide a unitary cut resistant fabric curtain and load retainer for enclosing the open ends of cargo containers having side walls, a top wall, and a bottom wall. As used here, cargo containers include uniform load devices (ULDs), air cargo containers, baggage trailers, sea-land containers, over-land trailers, and the like.

The unitary fabric curtain and load retainer includes at least one panel of fabric formed of at least one layer of fabric woven with yarns formed from fibers sufficiently cut and tear resistant to prevent cargo from penetrating the curtain. The fabric is desirably also resistant to heat, cold, ultraviolet (UV) radiation, and chemicals such as diesel and jet fuels and oils. Two such yarns formed from long chain polyethylene fibers are available from Honeywell under the trademark SPECTRA® or from DSM under the trademark DYNEEMA® However, any other suitable high-strength yarns having the characteristics described above may be used. The term "high strength yarns" means yarns formed from fibers having a tenacity exceeding 20 grams/denier, and desirably exceeding 30 grams/denier. The fabric may further be uncoated, coated, or laminated with a thermoplastic film.

The fabric closure is formed so that it substantially covers the open end of the cargo container. Preferably, at least some portion overlaps the peripheral edges of the cargo container side walls and top. The overlap portion provides an additional barrier to environmental or other anticipated undesirable elements, and this barrier may be further enhanced by securing the overlap portion around the periphery of the cargo container with a cable or the like that is inserted through a hem formed in the edge of the overlap portion and fastened to the lower front corners of the container.

Once the fabric closure has been secured around the periphery of the cargo container, it must be drawn taut to restrain cargo stowed in the container. One way of tensioning the fabric panel is by means of web straps and fasteners that are attached around at least part of the periphery of the fabric closure. For example, it may be desirable to attach the fabric cover along one side and along either the top or bottom of the cargo container with hooks that are attached to the outer edges of the fabric. Adjustable fasteners attached along the opposite side and top or bottom of the fabric closure may then serve the dual function of attaching the fabric closure to those sides of the cargo container as well as drawing the fabric taut, thereby restraining cargo stowed in the cargo container, while preventing items of cargo from slipping around or through the fabric closure. Preferably, the fabric closure is constructed so that opposed pairs of web straps are attached around the periphery of the fabric panel. The term "opposed pair" means that each strap of a pair is positioned at a point on the opposite side of the panel from the other so that the pair form a "load path". The straps are located to correspond with fasteners attached to the cargo container around the open end thereof. Again, each pair should include one member that is adjustable so that the cover can be made taut. When the strap pairs are attached co-linearly to a high-strength fabric panel such as that described herein, the straps and fabric combination provide load restraint at least equivalent to separately formed webbing or nets. The straps are formed of nylon, but any suitable high strength webbing material may be used. The term "high strength webbing" material means webbing having a tear strength of about 900 pounds or more per linear inch of webbing width. Desirably the straps are sewn to the fabric panel with a high strength thread such as SPECTRA® or DYNEEMA®. The web straps are secured to fasteners, such as hooks and buckles, for securing the top and opposed bottom portions of the fabric panel to the cargo container.

Access to the entire open end of a cargo container is obtained by simply loosening and removing some or all of the straps and fasteners from the cargo container. However, for limited access, such as for inspection, the adjustable fasteners on at least one side of the closure may be loosened so that a side portion of the closure may be folded back.

Alternatively, the closure may be constructed from two panels or from a single panel having an opening formed substantially along its length or width. Where such an opening is formed across the panel, additional fasteners are provided to appropriately close the opening for transit.

These and other aspects of the present invention will become apparent to those skilled in the art after a reading of the following description of the preferred embodiment when considered with the drawings.

DESCRIPTION OF THE PREFERRED EMBODIMENTS

Figure 1:
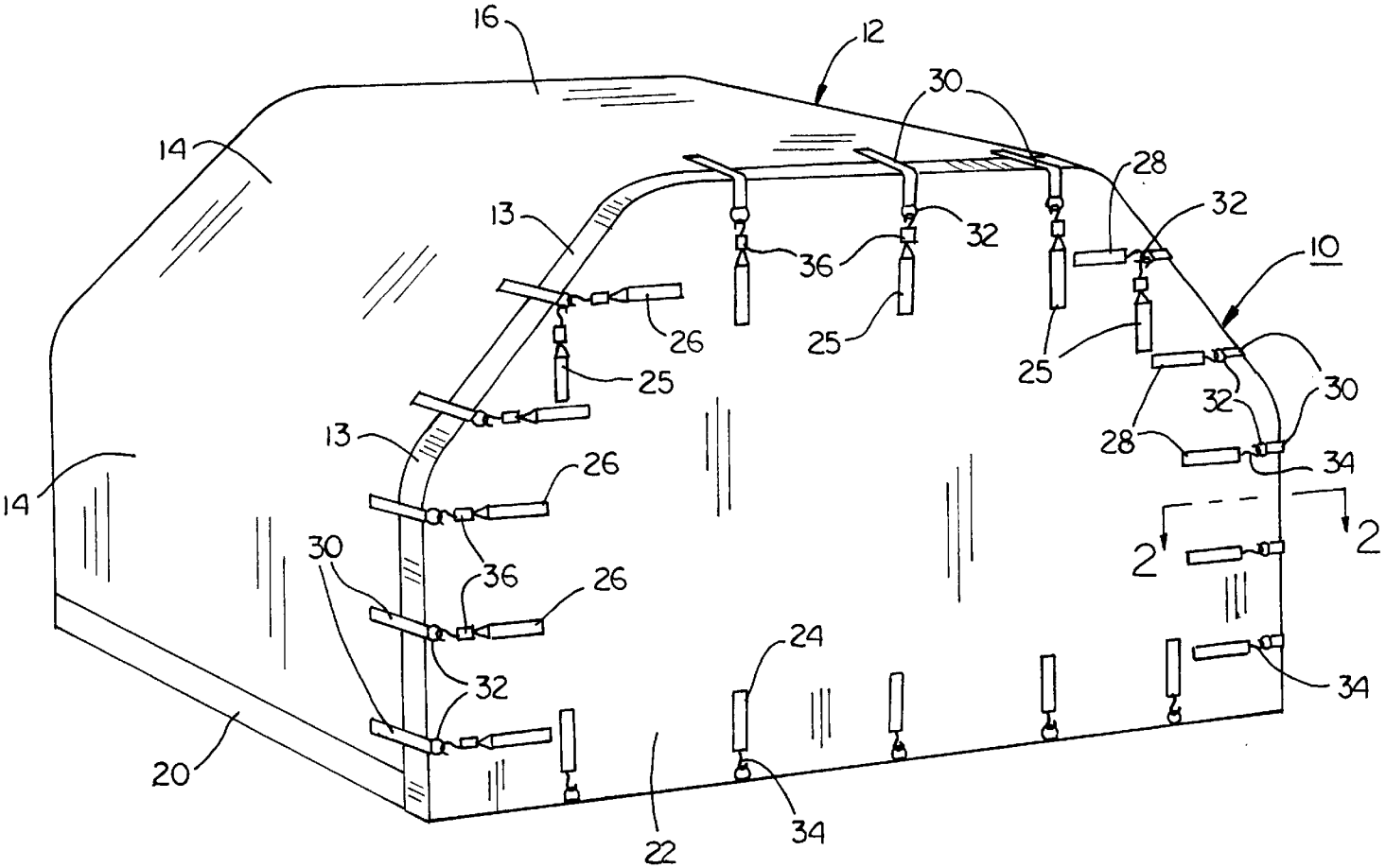
FIG. 1 is a schematic environmental view of a closure constructed according to the present invention.
Figure 4:
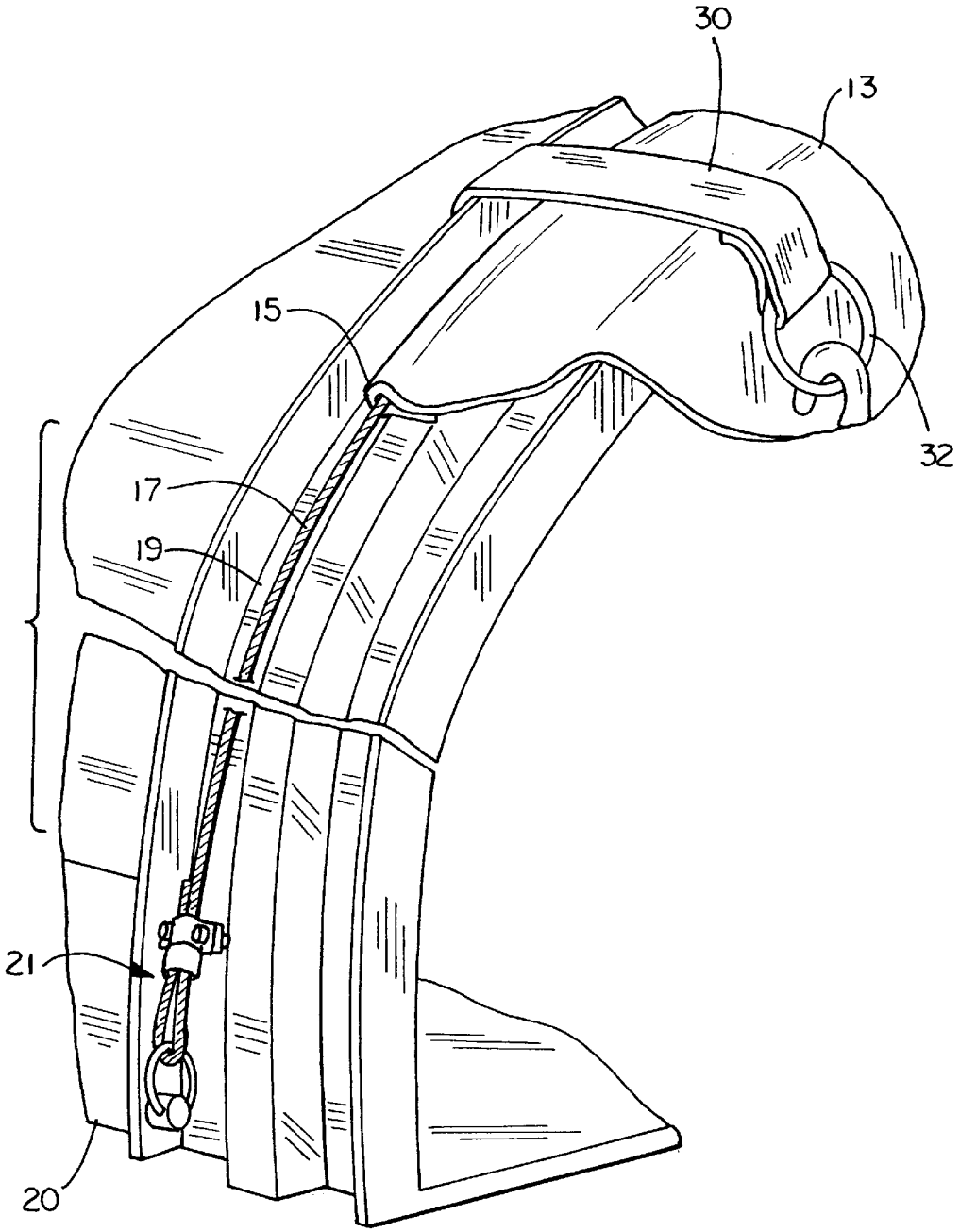
FIG. 4 is a front perspective view illustrating how the closure is secured around the periphery of the cargo container with a cable.

Referring now to the drawings in general and FIG. 1 in particular, it will be understood that the illustrations are for the purpose of describing a preferred embodiment of the invention and are not intended to limit the invention thereto. As best seen in FIG. 1, a unitary fabric closure that combines the functions of the separate cut-resistant fabric and of the webbing, is depicted generally as 10. Closure 10 is used in conjunction with a cargo container 12, having side walls 14, a top wall 16, and a bottom wall 20. While the cargo container 12 shown in FIG. 1 has a dome-shaped top wall 16, it will be appreciated by those skilled in the art that cargo containers 12 are manufactured in various shapes and sizes. Accordingly, side walls 14, top wall 16, and bottom wall 20 may vary. Closure 10 is formed from at least one panel 22 with at least one layer of a fabric woven with yarns formed from fibers sufficiently cut resistant to prevent penetration by cargo. Where added cut resistance and strength are required, multiple layers of woven fabric may be used to form a single panel 22. In the preferred embodiment, panel 22 is woven from yarns formed from long chain polyethylene fibers. Two yarns so formed are available from Honeywell under the trademark SPECTRA® or from DSM under the trademark DYNEEMA®; however, other high strength yarns having sufficient cut resistance, as well as resistance to ultraviolet radiation, diesel and jet fuels, and oils, may be used. The term "high strength yarns" means yarns formed from fibers having a tenacity exceeding 20 grams/denier, and desirably exceeding 30 grams/denier. Panel 22 is sized to completely cover the open end of cargo container 12 and to overlap the side and top edges of container 12 with an edge portion 13. Edge portion 13 provides an additional barrier to environmental or other anticipated undesirable elements. As shown in FIG. 4, a hem 15 may be formed in the outer edge of portion 13 for insertion therethrough by a cable 17. Edge portion 13 may then be secured around the periphery of container 12 by fastening opposite ends of cable 17 with clamps 21, or other suitable fasteners. Once secured with clamps 21, cable 17 provides a seal by snugly holding edge portion 13 in a channel 19, such a channel 19 being conventional for cargo containers.

As shown in FIG. 1, a plurality of opposed web strap pairs 24 and 25 are attached to the top and bottom portions of panel 22 in such fashion and alignment as to provide the same structural arrangement, or "load path," that a series of continuous web straps might have if attached separately. That is, the combination of a high strength fabric closure with web straps attached thereto along a common axis, forms at least the equivalent restraining force as continuous straps.

Similarly, opposed web strap pairs 26 and 28 are attached to opposing side portions of panel 22. Web straps 24, 25, 26, and 28 are formed from nylon, but other high strength webbing materials may be substituted. The term "high strength webbing" material means webbing having a tear strength of about 900 pounds or more per linear inch of webbing width. Straps 24, 25, 26, and 28 are desirably sewn to panel 22 with high strength threads such as SPECTRA®, or DYNEEMA® available from DSM.

Figure 2B:
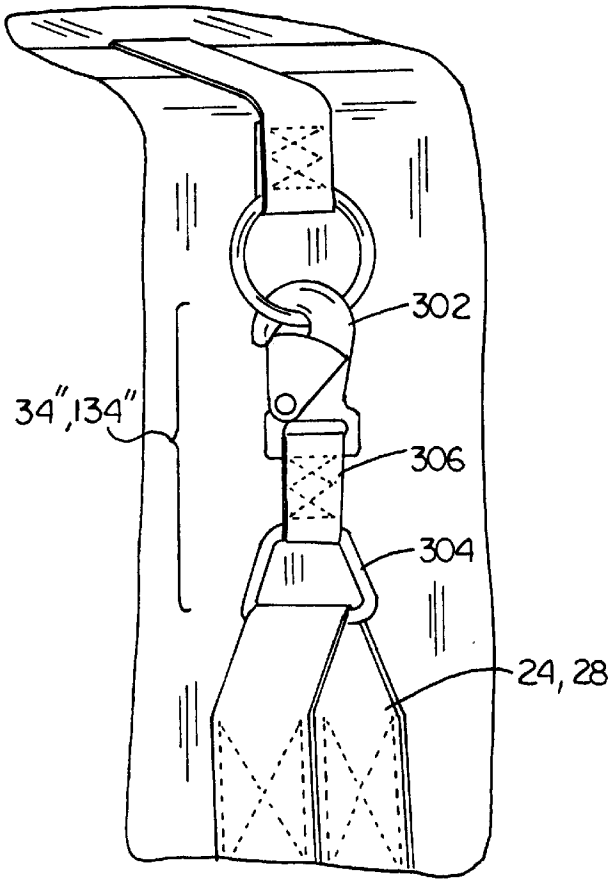
FIG. 2B is a perspective view of a snap hook assembly-type fastener for securing the closure to a cargo container.
Figure 2A:
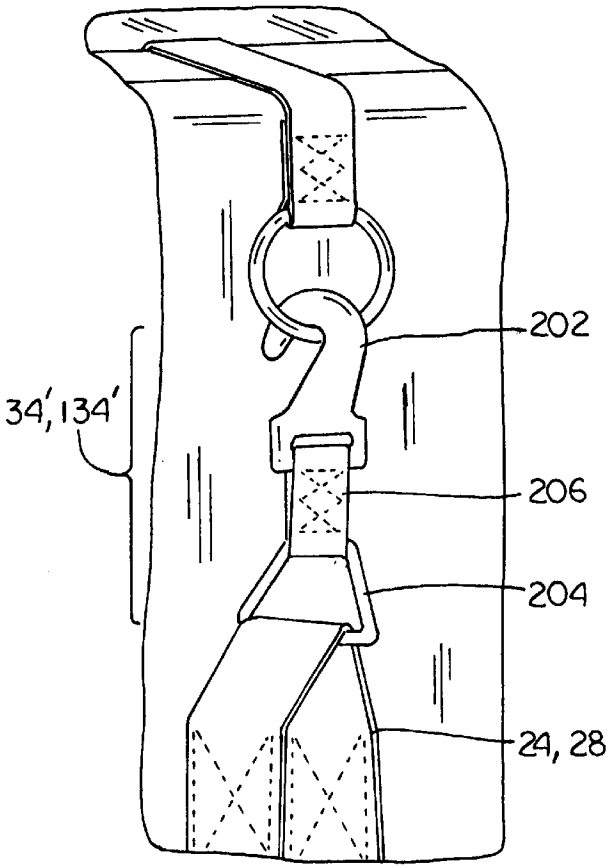
FIG. 2A is a perspective view of a hook assembly-type fastener for securing the closure to a cargo container.
Figure 2C:
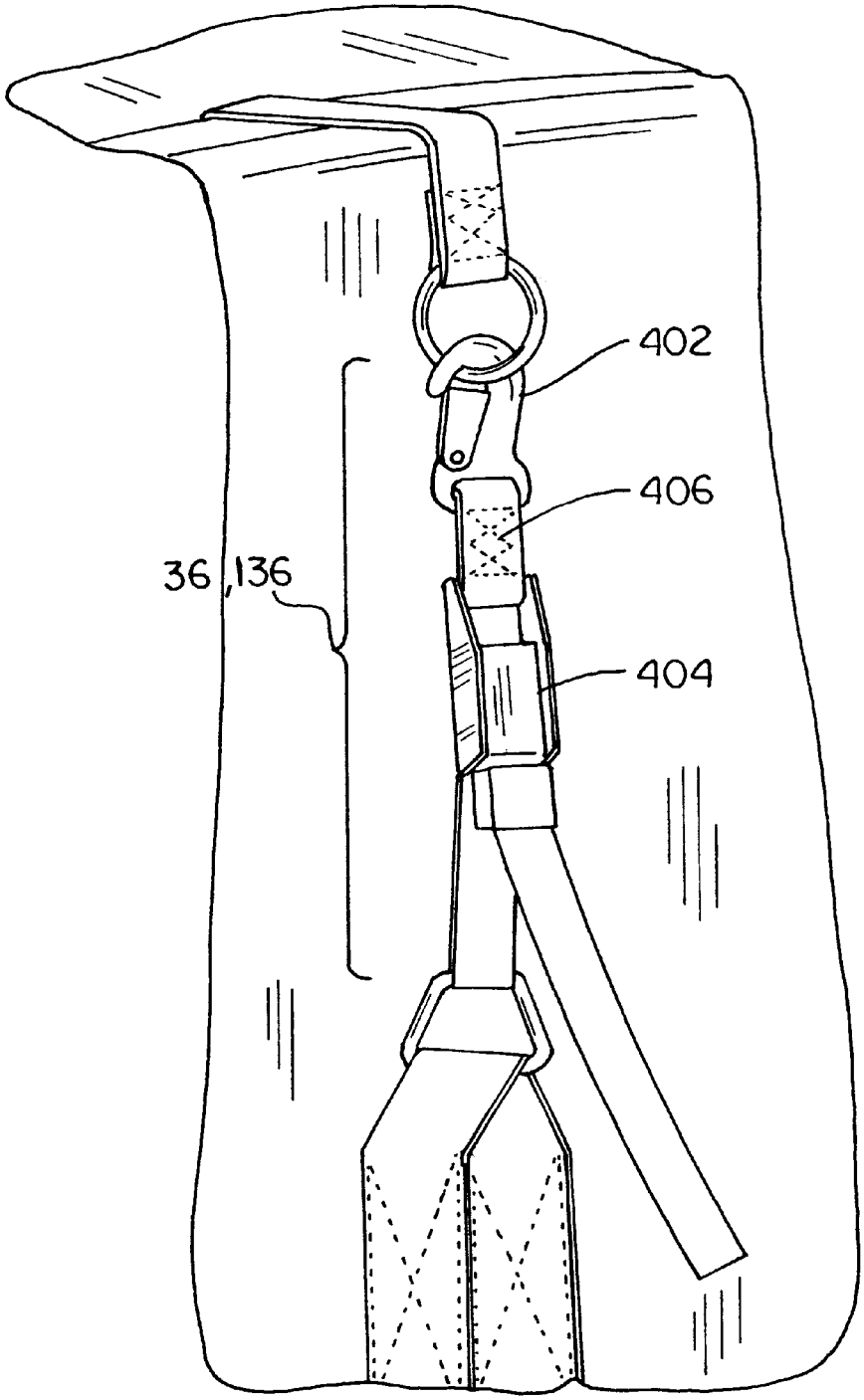
FIG. 2C is a perspective view of an adjustable snap hook assembly-type fastener for making the closure taut.
Figure 2D:
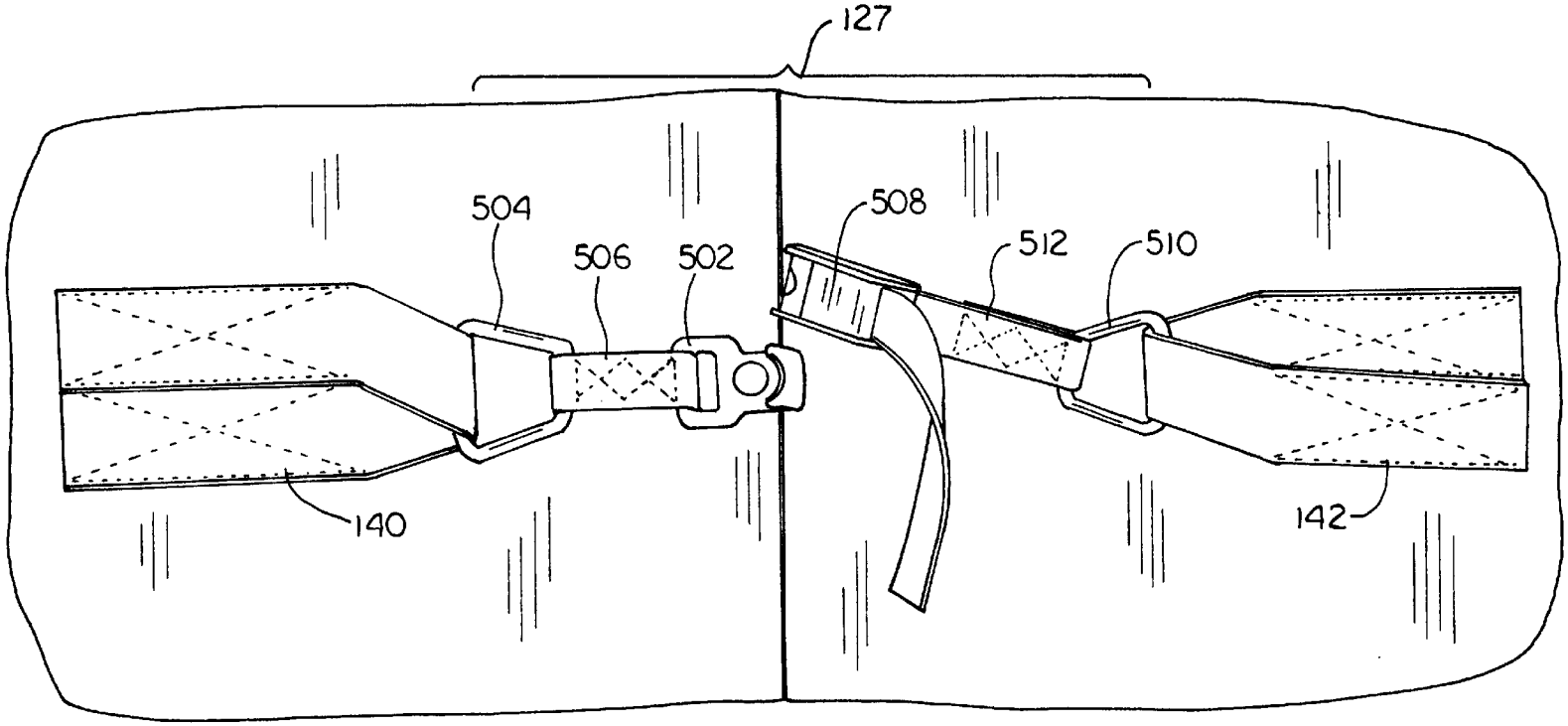
FIG. 2D is a perspective view of a flat hook and cam buckle assembly for making the closure taut.

As is standard in the transportation industry, cargo containers 12 are already normally supplied with a plurality of straps 30 with rings 32 affixed to cargo container 12 for attaching web straps or separate webbing thereto. Web straps 24, 25, 26, and 28 are aligned to correspond with straps 30 and rings 32 for convenient attachment thereto. A variety of fastener types are commercially available for attachment to the web straps. As shown in FIG. 1, fasteners 34 and 36 are attached to each of the web strap pairs 24, 25, and 26, 28. FIGS. 2A and 2B illustrate two types of fasteners 34' and 34" that are suitable for such attachment, although the choice of fasteners is dependent upon the specific container 12, government regulations regarding transportation of specific containers, and the particular application. While 34' is a simpler construction, 34" provides an additional measure of attachment. FIG. 2A shows fastener 34' as a simple hook assembly comprised of a hook 202 attached to a ring 204 with a strap portion 206. Fastener 34' is attached to panel 22 with strap 24 or 28. Hook 202 mates with ring 32 that is connected to cargo container 12 with strap 30. Strap portion 206, as well as strap portions 306, 406, and 506 shown in FIGS. 2B through 2D are designed as "sacrificial loops." That is, should hook 202 require replacement, strap portion 206 may be cut to enable such replacement. A new strap portion 206 may then be looped and sewn to connect a new hook 202 to ring 204 without the need for the timely and costly replacement or alteration of straps 24 or 28 attached to panel 22.

Similarly, FIG. 2B illustrates an alternative fastener 34" a snap-hook assembly comprised of a snap hook 302 attached to a ring 304 with a strap portion 306. Fastener 34" is attached to panel 22 with strap 24 or 28. Snap-hook 302 mates with ring 32 connected to cargo container 12 with strap 30. The fasteners shown in FIGS. 2A and 2B are but two possible fasteners that may be used from the variety of available fasteners. Fasteners 34 may be simple hooks, snap hooks, or other fasteners suitable for mating with rings 32. Since fasteners 34 are non-adjustable, desirably fasteners 36 are adjustable for taking up the slack in panel 22 and providing additional load restraint for the cargo stowed in container 12. FIG. 2C illustrates one possible adjustable fastener 36 suitable for such purpose, comprised of a snap-hook 402 connected to an adjustable buckle 404 with a strap portion 406. An adjustable strap portion 408 attaches buckle 404 to ring 410. Ring 410 attaches to strap 25,26, thereby securing fastener 36 to panel 22. Fastener 36 is attached to panel 22 with straps 25 and 26.

Figure 3:
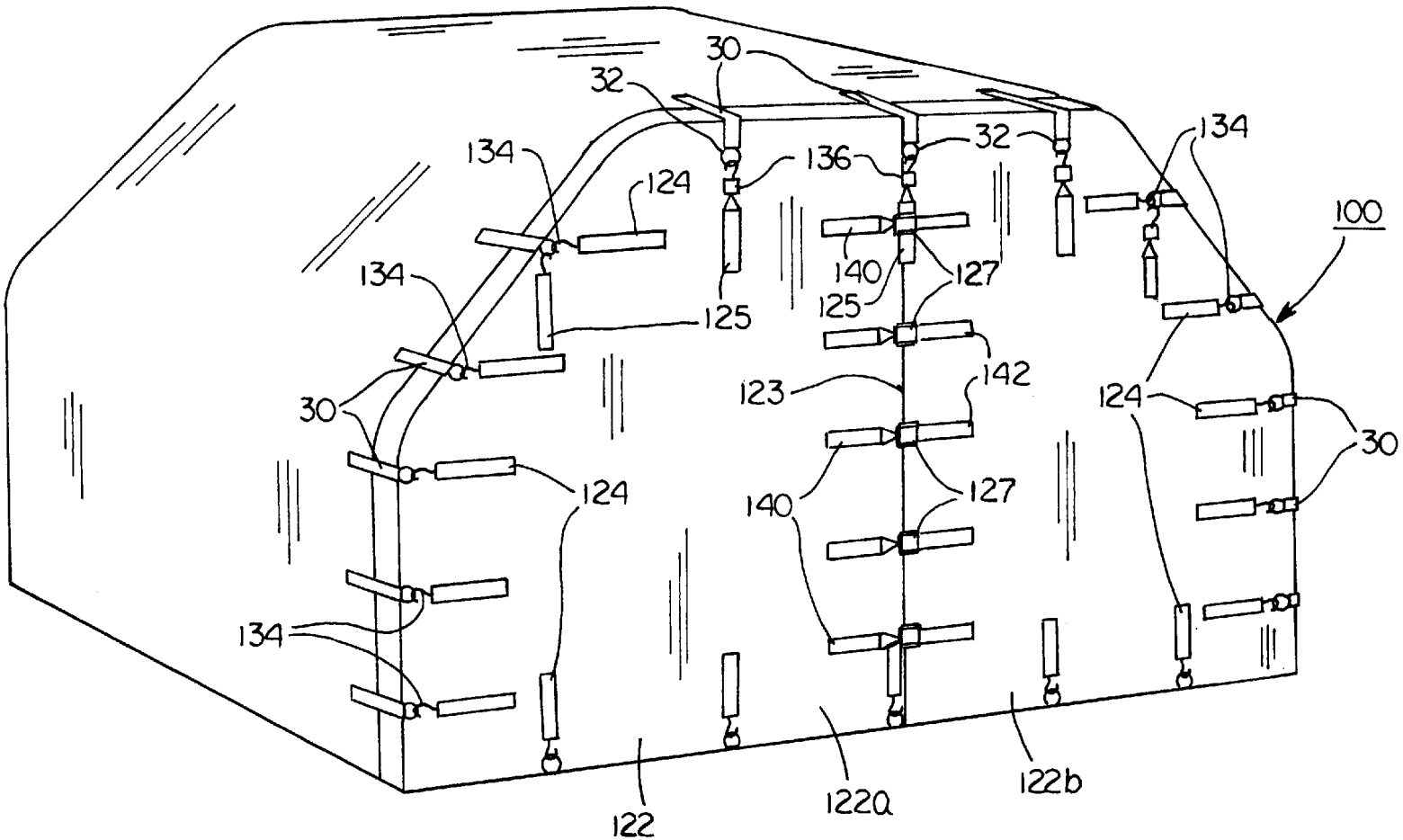
FIG. 3 is a schematic environmental view of the closure of FIG. 1 with an access opening formed in the closure.

As shown in FIG. 3, an alternative embodiment of the present invention, designated 100, includes a panel 122 formed with an opening 123 extending substantially the length of panel 122. Opening 123 may be formed in a single panel 122, or alternatively formed when panel 122 comprises two separate portions, shown in FIG. 3 as 122*a* and 122*b*. In this alternative embodiment, non-adjustable web straps 124 and fasteners 134 are attached to side portions of panels 122*a* and 122*b*. Web strap pairs 140 and 142 are connected with adjustable fasteners 127 to secure opening 123 for transit. Adjustable fasteners 127 function to take-up the slack in panel 122 in the horizontal direction, while also providing additional load restraint for the cargo in container 12. FIG. 2D illustrates one adjustable fastener 127 that preferably is used. Fastener 127 is comprised of flat hook 502 connected to ring 504 with strap portion 506. Ring 504 is attached with web strap 140 to panel section 122*a*. Hook 502 mates with adjustable cam buckle 508 that is connected to ring 510 with strap portion 512. Ring 510 is attached with strap 142 to panel section 122*b*. Non-adjustable straps 124 with fasteners 134, such as those fasteners shown in FIGS. 2A and 2B, are attached along the bottom and side portions of panels 122*a* and 122*b*, and straps 125 with adjustable fasteners 136 are attached along the top portion of panels 122*a* and 122*b*. Adjustable fasteners 136, such as that shown in FIG. 2C, function to take-up slack in the vertical direction and apply additional load restraint for the cargo in container 12.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A fabric closure for open end cargo containers of the type having a plurality of side walls, a top wall, a bottom wall, and fasteners connected to the side walls, top wall, and bottom wall at spaced points around at least one open end, said fabric closure comprising:

(a) at least one fabric panel formed of high-strength yarns made with fibers having a tenacity greater than about 20 grams/denier said fabric panel having top and bottom edges and opposed side edges, wherein the one panel is attached to the container side, top, and bottom walls adjacent the open end;

(b) a plurality of web straps, each web strap having one end attached to the panel at points spaced from but adjacent the top, bottom, and side edges and forming a marginal area of the panel, the other end of each web strap extending outwardly toward the top, bottom, and side edges of the panel for releasable attachment of a second end to the cargo container fasteners;

(c) said web straps arranged in opposed pairs along top and bottom edges and along opposed side edges, each of said opposed pairs of web straps when attached to the fasteners creating a load path across said fabric panel that restrains the cargo therein;

(d) the marginal area of the panel between the point of attachment of the straps and the adjacent edges forming side, top and bottom portions which wrap around the end of the container, the edges of the fabric panel including a hem through which a cable extends to secure the edges of the fabric panel around the end of the container;

(e) whereby the fabric panel is both cut-resistant and itself prevents passage of cargo items which may be stowed in the container around and through the fabric closure.

2. The fabric closure of claim 1 Wherein the web straps have a tear strength of greater than about 900 lbs per linear inch of web strap width.

3. The fabric closure of claim 1 further including an opening formed in the fabric panel for access therethrough, said opening extending substantially the length or width of said panel.

4. The fabric closure of claim 3 further including a plurality of web closure straps attached adjacent to and on both sides of said opening, said plurality of web closure straps having fasteners attached thereto for securing together both sides of the opening.

5. The fabric closure of claim 1 wherein the fabric is formed with yarn formed from and ultra-high molecular weight polyethylene fibers.

6. The fabric closure of claim 1 wherein the fasteners are attached to the web straps by sacrificial loops, allowing replacement of the fasteners without the need of replacing the entire web straps.

7. The fabric closure of claim 1 wherein the fasteners attach to the web straps are adjustable.

8. An open end cargo container and fabric closure comprising:

(a) a plurality of side walls, a top wall, a bottom wall, and at least one open end, and fasteners connected to the side walls, top wall, and bottom wall at spaced points around at least one open end;

(b) at least one fabric panel formed of high-strength yarns made with fibers having a tenacity greater than about 20 grams/denier said fabric panel having top and bottom edges and opposed side edges, wherein the one panel is attached to the container side, top, and bottom walls adjacent the open end;

(c) a plurality of web straps, each web strap having one end attached to the panel at points spaced from but adjacent the top, bottom, and side edges and forming a marginal area of the panel, the other end of each web strap extending outwardly toward the top, bottom, and side edges of the panel for releasable attachment of a second end to the cargo container fasteners;

(d) said web straps arranged in opposed pairs along top and bottom edges and along opposed side edges, each of said opposed pairs of web straps when attached to the fasteners creating a load path across said fabric panel that restrains the cargo therein;

(e) the marginal area of the panel between the point of attachment of the straps and the adjacent edges forming side, top and bottom portions which wrap around the end of the container, the edges of the fabric panel including a hem through which a cable extends to secure the edges of the fabric panel around the end of the container;

(f) whereby the fabric panel is both cut-resistant and itself prevents passage of cargo items which may be stowed in the container around and through the fabric closure.

9. The cargo container of claim 8 further including an opening in the at least one fabric panel for access therethrough, said opening extending substantially the length or width of the panel, and a plurality of web closure straps attached adjacent to and on both sides of the opening, the plurality of web closure straps having fasteners attached thereto for securing together both sides of the opening.

10. An open end cargo container and fabric closure comprising;

(a) A plurality of side walls, a top wall, a bottom wall, and at least one open end, fasteners connected to the side walls, top wall, and bottom wall at space points around the at least one open end;

(b) at least one fabric panel formed of high-strength yarns made with fibers having a tenacity greater than about 20 grams/denier said fabric panel having top and bottom edges and opposed side edges, wherein the one panel is attached to the container side, top, and bottom walls adjacent the open end;

(c) a plurality of web straps, each web strap having one end attached to the panel at points spaced from but adjacent the top, bottom, and side edges and forming a marginal area of the panel, the other end of each web strap extending outwardly toward the top, bottom, and side edges of the panel for releasable attachment of a second end to the cargo container fasteners;

(d) said web straps arranged in opposed pairs along top and bottom edges and along opposed side edges, each of said opposed pairs of web straps when attached to the fasteners creating a load path across said fabric panel that restrains the cargo therein;

(e) the marginal area of the panel between the point of attachment of the straps and the adjacent edges forming side, top and bottom portions which wrap around the end of the container, the edges of the fabric panel including a hem through which a cable extends to secure the edges of the fabric panel around the end of the container;

(f) whereby the fabric panel is both cut-resistant and itself prevents passage of cargo items which may be stowed in the container around and through the fabric closure.

11. The cargo container of claim 10 further including an opening formed in the fabric panel for access therethrough, said opening extending substantially the length or width of a panel, and further including a plurality of web closure straps attached adjacent to and on both sides of said opening, said plurality of web closure straps having fasteners attached thereto for securing together both sides of the opening.

* * * * *